US011807819B2

(12) United States Patent
Al-Majnouni et al.

(10) Patent No.: US 11,807,819 B2
(45) Date of Patent: Nov. 7, 2023

(54) PROCESS OF PRODUCING LIGHT OLEFINS AND AROMATICS FROM WIDE RANGE BOILING POINT NAPHTHA

(71) Applicant: SABIC Global Technologies B.V., Bergen op Zoom (NL)

(72) Inventors: Khalid A. Al-Majnouni, Riyadh (SA); Naif A. Al-Dalaan, Riyadh (SA); Ahmad M. Al-Shehri, Riyadh (SA); Nabil Al-Yasser, Riyadh (SA); Ahmed Al-Zenaidi, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 17/250,395

(22) PCT Filed: Jun. 24, 2019

(86) PCT No.: PCT/IB2019/055312

§ 371 (c)(1),
(2) Date: Jan. 15, 2021

(87) PCT Pub. No.: WO2020/021356

PCT Pub. Date: Jan. 30, 2020

(65) Prior Publication Data

US 2021/0269726 A1 Sep. 2, 2021

Related U.S. Application Data

(60) Provisional application No. 62/711,412, filed on Jul. 27, 2018.

(51) Int. Cl.
*C10G 63/08* (2006.01)
*C10G 51/04* (2006.01)
(Continued)

(52) U.S. Cl.
CPC ..... *C10G 63/08* (2013.01); *C10G 7/00* (2013.01); *C10G 51/04* (2013.01); *C10G 63/00* (2013.01);
(Continued)

(58) Field of Classification Search
CPC ..... C10G 51/04; C10G 63/00; C10G 63/08; C10G 69/08
See application file for complete search history.

(56) References Cited

U.S. PATENT DOCUMENTS 7,737,317 B1 * 6/2010 Schultz ..... C10G 70/041 208/92
9,434,894 B2 9/2016 Mehlberg et al.
(Continued)

FOREIGN PATENT DOCUMENTS

CN 105264050 1/2016
EP 3305748 4/2018
(Continued)

OTHER PUBLICATIONS

Wiley Critical Content—Petroleum Technology, vol. 1-2—Title Page. John Wiley & Sons., p. 431 (Year: 2007).*
(Continued)

*Primary Examiner* — Renee Robinson
(74) *Attorney, Agent, or Firm* — Norton Rose Fulbright US LLP

(57) ABSTRACT

Systems and methods for processing full range naphtha to produce light olefins are disclosed. The systems and methods include separating the full range naphtha into a light naphtha stream and a heavy naphtha stream and integrating a catalytic cracking with a naphtha reforming to process the light naphtha and heavy naphtha streams.

17 Claims, 2 Drawing Sheets

(51) Int. Cl.

| | |
|---|---|
| ***C10G 69/08*** | (2006.01) |
| ***C10G 7/00*** | (2006.01) |
| ***C10G 69/10*** | (2006.01) |
| ***C10G 63/00*** | (2006.01) |

(52) U.S. Cl.
CPC ..... *C10G 69/08* (2013.01); *C10G 69/10* (2013.01); *C10G 2300/301* (2013.01); *C10G 2300/4006* (2013.01); *C10G 2300/4012* (2013.01); *C10G 2300/4018* (2013.01); *C10G 2300/4025* (2013.01); *C10G 2400/20* (2013.01); *C10G 2400/30* (2013.01)

(56) References Cited

U.S. PATENT DOCUMENTS

| | | | | |
|---|---|---|---|---|
| 9,650,579 | B2 | 5/2017 | Fanget et al. | |
| 9,796,937 | B2 | 10/2017 | Fanget et al. | |
| 2005/0284794 | A1* | 12/2005 | Davis | C10G 65/12 208/89 |
| 2007/0083071 | A1 | 4/2007 | Choi et al. | |
| 2010/0230324 | A1* | 9/2010 | Al-Alloush | C10G 11/18 208/82 |
| 2014/0357913 | A1 | 12/2014 | Funk et al. | |
| 2015/0284644 | A1 | 10/2015 | Fanget et al. | |
| 2015/0284646 | A1 | 10/2015 | Fanget et al. | |
| 2018/0163147 | A1* | 6/2018 | Xie | C10G 69/04 |
| 2019/0062652 | A1* | 2/2019 | Weintrob | B01J 21/005 |

FOREIGN PATENT DOCUMENTS

| | | |
|---|---|---|
| JP | WO 2016/098909 | 6/2016 |
| WO | WO 2016098909 | 6/2016 |
| WO | WO 2016192041 | 12/2016 |

OTHER PUBLICATIONS

International Search Report and Written Opinion Issued in Corresponding PCT Patent Application No. PCT/IB2019/055312, dated Oct. 24, 2019.

Office Action issued in corresponding Chinese Application No. 201980049506.2, dated Apr. 6, 2022.

Dong, "Safe Operation and Management of Catalytic Reforming Unit", China Petrochemical Press, pp. 20-21, Oct. 2005.

Wei et al., "Chemical Engineering Technology", 4th edition, Chongqing University Press, pp. 323-324, Jan. 2015.

R. Pierce et. al., "Catalysis and Chemical Process", Chengdu University of Science and Technology Press, pp. 138-140, Mar. 31, 1990.

Office Action issued in corresponding Chinese Application No. 201980049506.2, dated Oct. 25, 2022.

Office Action issued in corresponding Chinese Application No. 201980049506.2, dated May 30, 2023.

Office Action issued in corresponding Saudi Application No. 521421122, dated Nov. 11, 2022.

* cited by examiner

PROCESS OF PRODUCING LIGHT OLEFINS AND AROMATICS FROM WIDE RANGE BOILING POINT NAPHTHA

CROSS REFERENCE TO RELATED APPLICATIONS

This application is a national phase application under 35 U.S.C. § 371 of International Application No. PCT/IB2019/055312 filed Jun. 24, 2019, which claims the benefit of priority to U.S. Provisional Patent Application No. 62/711,412, filed Jul. 27, 2018, the entire contents of which are hereby incorporated by reference in their entirety.

FIELD OF INVENTION

The present invention generally relates to the manufacture of light olefins ($C_2$-$C_4$ olefins, especially ethylene and propylene) from liquid hydrocarbons. More specifically, the invention relates to the manufacture of light olefins from liquid hydrocarbons having a final boiling point of less than 250° C. and containing paraffins, naphthenes and aromatics.

BACKGROUND OF THE INVENTION

Light olefins ($C_2$ to $C_4$ olefins) and single ring aromatics (BTX) including benzene, toluene, and xylene are chemicals commonly used for producing plastics and other polymers. For example, light olefins are used to produce polyethylene, polypropylene, ethylene oxide, ethylene chloride, propylene oxide, and acrylic acid, which, in turn, are used in a wide variety of industries such as the plastic processing, construction, textile, and automotive industries. Benzene is a precursor for producing polystyrene, phenolic resins, polycarbonate, and nylon. Toluene is used for producing polyurethane and as a gasoline component. Xylene is feedstock for producing polyester fibers and phthalic anhydride.

Conventionally, olefins are produced by steam cracking and/or paraffin dehydrogenation and BTX is produced by catalytic reforming of naphtha in addition to the steam cracking of liquid feed. As the demand for olefins and BTX has been consistently increasing for the last few decades, the current market supply for these chemicals may not be sufficient. Although steam cracking of hydrocarbons is the most common method to produce light olefins, many other processes, including catalytic cracking of naphtha, have been utilized to meet the increasing market demand for light olefins. Thus, alternative routes for producing olefins and/or BTX are needed.

Catalytic cracking is a process capable of producing both light olefins and BTX using whole naphtha (also called full range naphtha) as a feedstock. It generally converts a hydrocarbon mixture with initial boiling point less than 250° C. to light olefins and BTX. It would be of great commercial interest to use full range naphtha as a feed source for producing olefins and single ring aromatics because it contains paraffins, naphthenes and aromatics. Unfortunately, full range naphtha may not be the ideal feed for steam cracking or catalytic cracking to produce light olefins as it leads to considerable coke formation and pyrolysis fuel oil. In addition, full range naphtha is not generally considered to be a good feed for naphtha reforming to produce, e.g., aromatics, particularly due to the presence of lighter components such as pentanes. Therefore, improvements in this field are desired.

Multiple processes are currently used to make use of full range naphtha feed for olefin production. For example, in refining, the light straight run naphtha is typically isomerized while heavy naphtha is reformed to produce gasoline. Light olefins producers prefer to use light naphtha as a feed.

US 2014/0357913 A1 discloses a process for increasing the yields of light olefins and the yields of aromatics from a hydrocarbon stream. The process includes a first separation to direct the light components that are not reformable to a cracking unit, with the remainder passed to a second separation unit. The second separation unit extracts normal components from the hydrocarbon stream to pass to the cracking unit. The resulting hydrocarbon stream with reduced light ends and reduced normals is passed to a reforming unit.

US 2015/0284644 relates to fluid catalytic cracking (FCC) units processing heavy feedstocks enriched with hydrogen, such as for example a highly hydrotreated vacuum gas oil (VGO), or the unconverted part at the end of hydrocracking this same type of VGO feedstock, and feedstocks which have the characteristic of cracking to light olefins such as ethylene and propylene. The integration of an FCC with an aromatic complex allows the recovery by the aromatic complex of the BTX (benzene, toluene, xylenes) formed in the FCC, and the recovery by the FCC from the flow at the bottom of the column, of heavy aromatics from the aromatic complex.

US 2015/0284646 concerns a process for the production of light olefins and BTX using a Naphtha Catalytic Cracking (NCC) unit, processing a naphtha type feed, and an aromatics complex. It can be used to exploit the synergies between these two units. The thermal balance of the NCC, which is intrinsically deficient in coke, is resolved by the optimal use of heat from the reforming furnaces in order to preheat the feed for the NCC, and by introducing at least a portion of the raffinate obtained from the aromatics complex as a mixture with the naphtha.

U.S. Pat. No. 9,434,894 B2 describes a method and apparatus for processing hydrocarbons including the step of fractionating a hydrocarbon stream to form at least two fractions. The first fraction is reformed to form a reformate stream, and the reformate stream is introduced into an aromatics processing zone to produce aromatic products. At least a portion of the second fraction is cracked in a fluid catalytic cracking unit. A selectively hydrogenated light naphtha stream is formed by separating the cracked hydrocarbon stream into at least two streams and selectively hydrogenating the light naphtha stream, or selectively hydrogenating the cracked hydrocarbon stream and separating the hydrogenated cracked hydrocarbon stream into at least two streams. Aromatics are extracted from the selectively hydrogenated light naphtha stream forming an extract stream and a raffinate stream. The extract stream is hydrotreated, then sent to the aromatics processing zone to produce additional aromatic products.

U.S. Pat. No. 9,796,937 concerns a process for the production of light olefins and BTX using a catalytic cracking unit, NCC, processing a naphtha type feed, and an aromatics complex that can be used to exploit the synergies between these two units. The thermal balance of the NCC, which is intrinsically deficient in coke, is resolved by the optimal use of heat from the reforming furnaces in order to preheat the feed for the NCC, and by introducing at least a portion of the raffinate obtained from the aromatics complex as a mixture with the naphtha.

Improvements in this field are clearly desired given the problems mentioned above.

OBJECTS OF THE INVENTION

It is, therefore, an object of the invention to process full range naphtha with the objective to maximize light olefin production.

It is also an object of the invention to maximize aromatics production, particularly of benzene, toluene and xylene (BTX).

BRIEF SUMMARY OF THE INVENTION

The above objectives and others are achieved according to the present invention, which provides a solution to at least some of the above-mentioned problems associated with the process of light olefin production from full range naphtha. The solution resides in a method that integrates a catalytic cracking process with a naphtha reforming process. This can be beneficial for improving the yield of light ($C_2$ to $C_4$) olefins from full range naphtha. Therefore, the methods of the present invention provide a technical advantage over at least some of the problems associated with the currently available methods for processing full range naphtha to produce light olefins mentioned above.

Embodiments of the invention are achieved by integrating catalytic cracking process with naphtha reforming process. This may be accomplished by first separating a full range naphtha feedstock into a light naphtha stream and heavy naphtha stream. The full range naphtha has a final boiling point less than 250° C., and preferably has an initial boiling point (IBP) of 30° C. to 50° C. and a final boiling point (FBP) of 210° C. to 220° C. The heavy naphtha stream has an IBP of 60° C. to 65° C. and a FBP of 210° C. to 220° C. and the light naphtha fraction has an IBP of 30° C. to 35° C. and a FBP of 40° C. to 50° C. The light naphtha stream is subjected to catalyzed cracking, e.g., with an FCC unit, to produce a stream that is separated into, among other things, light olefins, and a heavy hydrocarbon fraction stream containing $C_7$ to $C_{12}$ hydrocarbons. This heavy hydrocarbon fraction stream from the catalytic cracking unit is mixed with the heavy naphtha stream to yield a combined feed that is hydrotreated to remove impurities and to hydrogenate any olefins present. The resultant hydrotreated stream is then fed to another separation unit where any paraffins present are extracted, leaving an easily reformable stream to the reforming unit.

In embodiments, the light naphtha and the hydrotreated extracted paraffin are combined and sent to catalytic cracking process where light olefins are generated. An effluent of a catalytic cracking unit is separated into a light olefins stream, a gas stream comprising methane and hydrogen, a $C_4$ to $C_6$ hydrocarbon stream, a $C_2$ to $C_3$ paraffins stream, and a fuel oil stream. Light olefins are recovered in the recovery section from the light olefins stream. The $C_4$ to $C_6$ hydrocarbon stream, the unconverted portion consisting of paraffins, olefins and naphthenes but no aromatic, is recycled to the catalytic cracking unit and the heavy naphtha range ($C_6$ to $C_{12}$ hydrocarbons) is sent to the hydrotreating unit. To further increase the olefins content, the ethane and propane produced by heavy naphtha reforming and catalytic cracking process can be sent to steam cracking furnaces. These cracking furnaces can share the same recovery section.

Embodiments of the invention are directed to a method for processing full range naphtha, the method includes the steps of feeding naphtha to a separation unit, the naphtha having a final boiling point less than 250° C.; separating the naphtha, in the separation unit, to produce a light naphtha stream having a final boiling point in a range of about 60° C. to 110° C. and a heavy naphtha stream having a final boiling point less than 250° C.; hydrotreating the heavy naphtha stream in a hydrotreatment unit to produce a hydrotreated stream, separating the hydrotreated stream to produce a paraffinic stream comprising primarily paraffins and a reformable stream comprising 40 to 80 wt. % aromatics and the remainder naphthene; reforming the reformable stream to produce an aromatic stream comprising greater than 60 wt. % aromatics, combining the light naphtha stream with the paraffinic stream that separated from the combined heavy naphtha stream to produce a combined stream, catalytically cracking the combined stream to form a cracked stream, separating the cracked stream to produce a plurality of product streams that include a first stream that comprises primarily $C_2$ to $C_3$ paraffins, and steam cracking the first stream to produce $C_2$ to $C_4$ olefins.

Embodiments relate to a method for processing naphtha. The method includes the steps of feeding naphtha to a separation unit, the naphtha having a final boiling point less than 250° C., separating the naphtha, in the separation unit, to produce a light naphtha stream having a final boiling point in a range of 60° C. to 110° C. and a heavy naphtha stream having a final boiling point of less than 250° C., combining the heavy naphtha stream with a recycle stream coming from the process comprising primarily $C_6$ to $C_{12}$ hydrocarbons to form a combined heavy stream, hydrotreating the combined heavy stream to produce a hydrotreated stream, separating the hydrotreated stream to produce a paraffinic stream comprising primarily paraffins and a reformable stream comprising 40 to 80 wt. % aromatics and the remainder naphthene, reforming the reformable stream to produce an aromatic stream comprising primarily above 60 wt. % aromatics, combining the light naphtha stream with the paraffinic stream that separated from the combined heavy naphtha stream to produce a combined stream, catalytically cracking the combined stream to form a cracked stream, separating the cracked stream to produce a plurality of product streams that includes (1) a first stream that contains primarily $C_2$ to $C_3$ paraffins, (2) a second stream containing primarily methane ($CH_4$) and hydrogen ($H_2$), (3) a third stream containing primarily $C_2$ to $C_4$ olefins, (4) a fourth stream primarily containing $C_4$ to $C_6$ hydrocarbons, (5) a fifth stream containing primarily $C_6$ to $C_{12}$ hydrocarbons and (6) sixth stream containing primarily fuel oil, and steam cracking the first stream to produce $C_2$ to $C_4$ olefins.

Embodiments of the invention also relate to a system for producing light olefins and other products from full range naphtha. The system has a naphtha separator for separating the full range naphtha into a light naphtha stream and a heavy naphtha stream, a hydrotreater for hydrotreating the heavy naphtha, a separator for separating $C_6$ to $C_{12}$ paraffins from the hydrotreated product, and a reformer for reforming the remainder of the hydrotreated product. The system also includes a catalytic cracker for catalytically cracking the combined $C_6$ to $C_{12}$ paraffins, light naphtha stream and the $C_4$-$C_6$ recycle stream, a separator for separating at least light olefins and $C_2$ to $C_3$ paraffins, and a steam cracker for cracking the $C_2$ to $C_3$ paraffins to produce additional light olefins.

The following includes definitions of various terms and phrases used throughout this specification.

The term "full range naphtha" as used herein refers to a hydrocarbon fraction distilled from crude oil that contains primarily $C_5$ to $C_{12}$ hydrocarbons and has a boiling point of below 250° C. For purposes of this invention, full range naphtha contains a heavy naphtha fraction and a light naphtha fraction as described herein, and these fractions can be separated.

The term "heavy naphtha" as used herein refers to the hydrocarbon fraction containing $C_6$ to $C_{12}$ hydrocarbons that is separated from the full range naphtha and comprises primarily $C_6$ to $C_{12}$ hydrocarbons. The heavy naphtha has a final boiling point in the range of less than 250° C.

The term "light naphtha" as used herein refers to a fraction that is separated from the full range naphtha, and comprises $C_6$ or less hydrocarbons. The light naphtha has a final boiling point in the range of 60 to 110° C.

The term "light olefins" refers to $C_2$ to $C_4$ olefins including e.g., ethylene, propylene, and butylene, and includes straight chain or branched variants thereof.

The term "reformable stream is the portion remaining after paraffin and olefins removal. The reformable stream contains mainly aromatics and naphthenes, e.g., from at least 50 to 100 wt. % of the combined amount of aromatics and naphthenes, preferably 60-90 wt. %.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %," "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

In the context of the present invention, at least twenty embodiments are now described. Embodiment 1 is a method for processing full range naphtha. The method includes the steps of feeding full range naphtha to a separation unit, the full range naphtha having a final boiling point less than 250° C.; separating the naphtha, in the separation unit, to produce a light naphtha stream having a final boiling point in a range of about 80° C. to 110° C. and a heavy naphtha stream having a final boiling point less than 250° C.; hydrotreating the heavy naphtha stream in a hydrotreatment unit to produce a hydrotreated stream; separating the hydrotreated stream to produce a paraffinic stream comprising primarily paraffins and a reformable stream comprising from 40 to 80 wt. % aromatics and the remainder naphthenes; reforming the reformable stream to produce an aromatic stream comprising greater than 50 wt. % aromatics; combining the light naphtha stream with the paraffinic stream to produce a combined stream; catalytically cracking the combined stream to form a cracked stream; separating the cracked stream to produce a plurality of product streams that includes a first stream that contains primarily $C_2$ to $C_3$ paraffins; and steam cracking the first stream to produce $C_2$ to $C_4$ olefins. Embodiment 2 is the method of embodiment 1, further comprising recovering $C_2$ to $C_4$ olefins. Embodiment 3 is the method of any of embodiments 1 and 2, wherein the steam cracking is performed under process conditions including a cracking temperature of 400 to 1000° C. and a residence time of 0.1 to 10 s. Embodiment 4 the method of any of embodiments 1 to 3, wherein the separation unit includes a distillation unit. Embodiment 5 is the method of any of embodiments 1 to 4, wherein the separation unit is operated under process conditions including an operating temperature of 100° C. to 800° C. Embodiment 6 is the method of any of embodiments 1 to 5, wherein the separation unit is operated under process conditions including an operating pressure of 1 to 50 bar. Embodiment 7 is the method of any of embodiments 1 to 6, wherein the catalytic cracking is performed under process conditions including an operating temperature of 600 to 750° C. Embodiment 8 is the method of any of embodiments 1 to 7, wherein the catalytic cracking is performed under process conditions including an operating pressure of 1 to 4 bar. Embodiment 9 is the method of any of embodiments 1 to 8, wherein the catalytic cracking is performed in the presence of a catalyst selected from the group consisting of active amorphous clay-type catalyst or crystalline molecular sieves. Zeolites are commonly used molecular sieves in FCC processes. Others that may be used include a X-type zeolites, Y-type zeolites, ferrierite, erionite, mordenite, faujasite, ST-5, ZSM-5, ZSM-11, ZSM-12, ZSM-23, ZSM-35, ZSM-38 and ZSM-48, germanium, gallium, and combinations thereof. Embodiment 10 is the method of any of embodiments 1 to 9, wherein separating the hydrotreated stream comprises distilling. Embodiment 11 is the method of any of embodiments 1 to 10, wherein the full range naphtha is obtained from distilling crude oil. Embodiment 12 is the method of embodiments 1 to 11 further including the step of separating the hydrotreated stream to produce a $C_6$-$C_{12}$ paraffinic stream comprising greater than 50% by weight paraffins and a reformable stream comprising aromatic precursors from the heavy naphtha stream; and reforming the reformable stream to produce an aromatic stream comprising at least 50 wt. % aromatics. Embodiment 13 is the method according to embodiment 12, wherein the separating of the cracked stream produces a plurality of product streams that includes (1) a first stream that contains primarily $C_2$ to $C_3$ paraffins, (2) a second stream comprising primarily methane ($CH_4$) and hydrogen ($H_2$), (3) a third stream comprising primarily $C_2$ to $C_4$ olefins, (4) a fourth stream primarily comprising $C_4$ to $C_6$ hydrocarbons which will be recycled to the catalytic cracking section, (5) a fifth stream comprising primarily fuel oil and (6) a sixth stream comprising $C_6$-$C_{12}$ hydrocarbons; and steam cracking the first stream to produce $C_2$ to $C_4$ olefins. Embodiment 14 is the method according to any of embodiments 1 to 13, wherein the full range naphtha contains 20 to 60 wt. % paraffins, 5 to 35 wt. % naphthenes, and 5 to 35 wt. % aromatics. Embodiment 15 is the method according to embodiments 1 to 14, wherein the light naphtha contains primarily $C_5$ to $C_6$ hydrocarbons. Embodiment 16 is the method according to any of embodiments 1 to 15, wherein 35 wt. % to 90 wt. % olefins and aromatics are produced per mass unit of naphtha. Embodiment 17 is the method according to any of embodiments 1 to 16, wherein the hydrotreating removes at least one member selected from the group consisting of sulfur and nitrogen. Embodiment 18 is the method according to any of embodiments 1 to 17, wherein unconverted hydrocarbons from the catalytic cracking is returned for further catalytic cracking. Embodiment 19 is the method according to any of embodiments 1 to 18, wherein the conditions for the hydrotreating include a temperature in a range of 300° C. to 500° C., a pressure in a range of about 50 psig to about 2000 psig, and a space velocity of 0.1 LHSV to 20.0 LHSV.

Embodiment 20 is a system for producing light olefins from a full range naphtha feed. The system includes a separation unit for separating a full range naphtha feed into a light naphtha stream and a heavy naphtha stream; a hydrotreater for hydrotreating the heavy naphtha stream; a separator for separating the hydrotreated heavy naphtha stream into a $C_6$-$C_{12}$ paraffins containing stream and a reformable stream; a reforming unit for reforming the reformable stream to produce aromatics; a light naphtha catalytic cracking unit for cracking light naphtha and paraffins into a catalytically cracked product; a separator for separating the catalytically cracked product to yield a light olefin stream, a $C_2$-$C_3$ paraffin stream and a $C_7$-$C_{12}$ hydrocarbon stream; and a steam cracker for steam cracking the $C_2$-$C_3$ paraffin stream to produce light olefins.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWING

For a more complete understanding, reference is now made to the following descriptions taken in conjunction with the accompanying drawings, in which.

DETAILED DESCRIPTION OF THE INVENTION

A discovery has been made of a process and a system that addresses the current problems associated with processing full range naphtha to yield light olefins and other products. The process includes the use of an integrated naphtha reforming process and a cracking process for catalytically cracking light naphtha. The light naphtha is separated from the full range naphtha and fed to a catalytic cracker such as an (fluid catalytic cracker) FCC, while the heavy naphtha is hydrotreated, paraffins removed via separation, and the product is fed to a reforming unit. The removed paraffins are optionally combined with the light naphtha stream and cracked. The cracked product is separated into various streams, including a light olefin stream which are then either recovered or further processed. A $C_2$ to $C_3$ paraffin stream produced by separating the cracked light naphtha stream may be further processed to yield additional light olefins.

Figure 1:
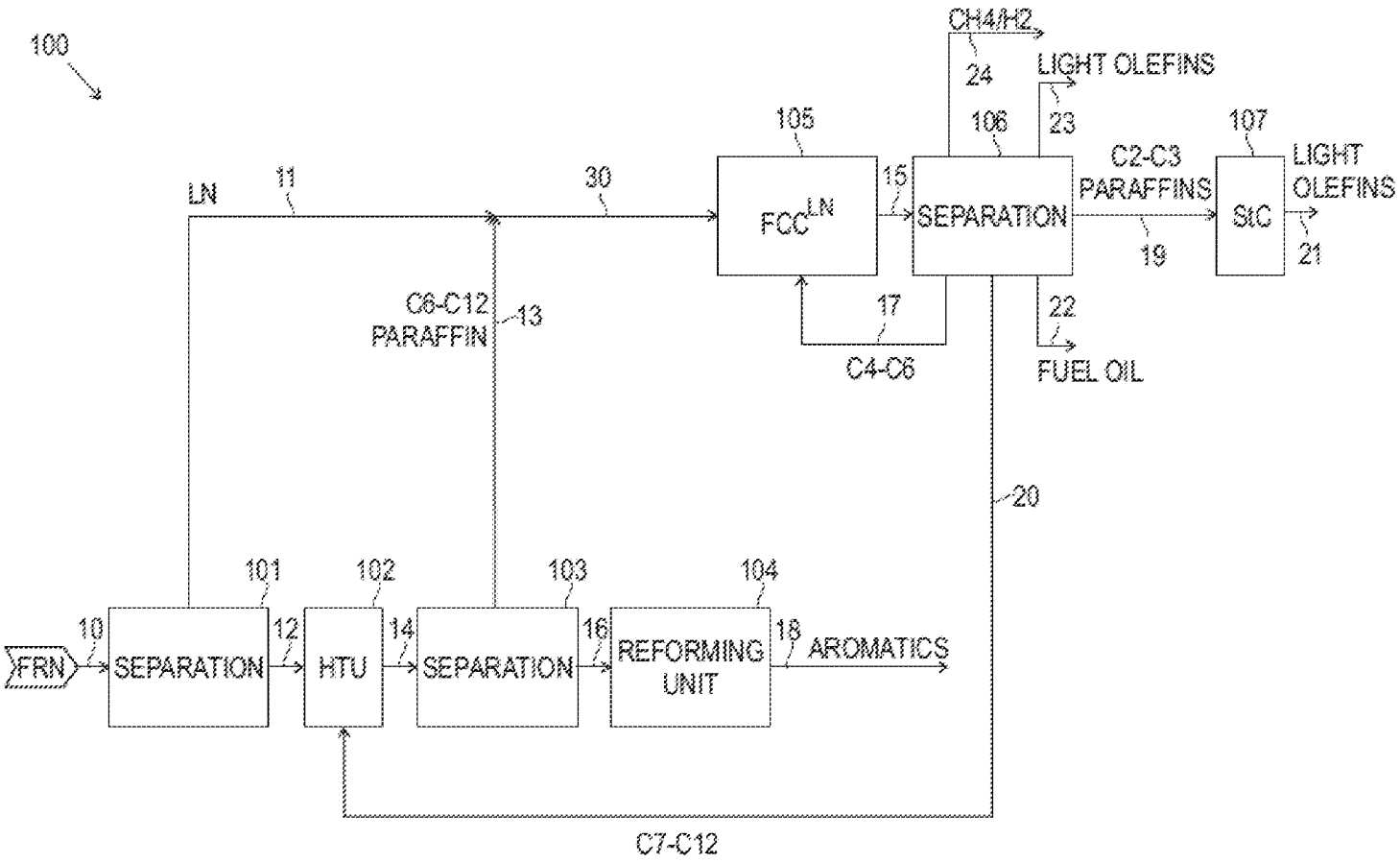
FIG. 1 shows a system for producing light olefins from full range naphtha according to the invention integrating naphtha reforming and cracking processes.

FIG. 1 shows a system 100 for producing light olefins from full range naphtha by integrating naphtha reforming and cracking processes, according to embodiments of the invention. The full range naphtha feed stream 10 may be supplied to system 100 from other refinery processes such as a crude oil distillation process. The full range naphtha feed stream 10 includes a heavy naphtha component and a light naphtha component. Full range naphtha feed stream 10 is supplied via a separation unit inlet to a full range naphtha separation unit 101 which can separate the full range naphtha feed into a stream containing primarily light naphtha 11 and heavy naphtha 12. Light naphtha stream 11 exits an outlet of the full range naphtha separation unit 101 and is fed to cracking unit 105 via an inlet, preferably after mixing with a $C_6$ to $C_{12}$ paraffinic stream 13 containing primarily paraffins as described further below. Light naphtha cracking unit 105 is preferably a fluid catalytic cracker that cracks light naphtha, paraffins, or other hydrocarbons to yield a first cracked product effluent stream 15 containing light olefins that exits the light naphtha cracking unit 105 via an outlet.

The conditions in cracker 105 may include a temperature of from 400 to 1000° C., preferably from 450 to 900° C., and more preferably from 500 to 800° C.

Flow rates through the cracker may include diluted steam and possibly dry gas to control the partial pressure of hydrocarbons and improve catalyst fluidization.

If the cracker is a fluid catalytic cracker, the catalyst includes, preferably, catalysts that are used in the art of fluidized catalytic cracking, such as active amorphous clay-type catalyst or crystalline molecular sieves. Zeolites are commonly used molecular sieves in FCC processes. Others that may be used include X-type zeolites, Y-type zeolites, ferrierite, erionite, mordenite, faujasite, ST-5, ZSM-5, ZSM-11, ZSM-12, ZSM-23, ZSM-35, ZSM-38 and ZSM-48, germanium, gallium, or any combination thereof.

First cracked product effluent stream 15 is fed via an inlet into a second separation unit 106 that separates a light olefin stream 23 containing the desired light olefins that exits separation unit 106 via an outlet, and other products from the first cracked product effluent stream 15. Those other products may include a methane and hydrogen containing stream 24, which exits the second separation unit 106 via an outlet, a first stream 19 that contains primarily $C_2$ to $C_3$ paraffins that exits second separation unit 106 via an outlet, $C_7$ to $C_{12}$ hydrocarbon stream 20 that exits second separation unit 106 via an outlet, $C_4$ to $C_6$ hydrocarbon stream 17 that exits second separation unit 106 via an outlet, and a fuel oil stream 22 that exits second separation unit 106 via an outlet. Any of the streams exiting second separation unit 106 may be recovered or further processed, as described further below.

Second separation unit 106 may include a series of separation vessels, distillation columns, gas compressors, quench towers, caustic tower, dryers and other equipment known in the art.

The $C_2$ to $C_3$ paraffin containing first stream 19 is optionally and preferably fed to steam cracker 107 via an inlet and steam cracked to produce light olefins 21, which is recovered and combined with the light olefin, 23 from second separation unit 106.

The conditions in the steam cracker may include dilution steam and processed in conventional steam cracking furnaces. The steam cracking furnaces operating conditions are known in the industry and by people of skill in the art.

Heavy naphtha stream 12 exits first separation unit 101 via an outlet and is fed into a hydrotreatment unit 102 via an inlet to produce hydrotreated stream 14. Preferably, $C_7$ to $C_{12}$ containing hydrocarbon stream 20 from second separation unit 106 is also fed into hydrotreatment unit 102 via an inlet, and the streams 12 and 20 are hydrotreated to yield hydrotreated stream 14, which exits hydrotreatment unit 102 via an outlet and is fed to third separation unit 103 via an inlet. Third separation unit 103 separates hydrotreated stream 14 into a paraffinic stream 13 which exits via an outlet and a reformable stream 16 which exits third separation unit 103 via an outlet. Paraffinic stream 13 preferably contains primarily $C_6$ to $C_{12}$ hydrocarbons. Reformable stream 16 is then routed to a reforming unit 104 via an inlet, while paraffinic stream 13 is mixed with light naphtha containing stream 11 to form mixed stream 30, which is fed into cracking unit 105 via an inlet where it is cracked as described above. Not shown in the figure, the steam 12 is combined with hydrogen to carry out the hydrotreatment chemistry.

The $C_4$ to $C_6$ hydrocarbon stream 17 is routed to cracker 105 via an inlet where it is cracked along with the hydrocarbons of combined stream 30. Stream 30 is formed by combining light naphtha stream 11 and paraffinic stream 13 prior to entering light naphtha cracker 105.

Reforming unit 104 reforms the hydrocarbons of reformable stream 16 to produce, among other things, aromatics which exit reforming unit 104 via an outlet as aromatic stream 18. The aromatics include BTX may be recovered.

Figure 2:
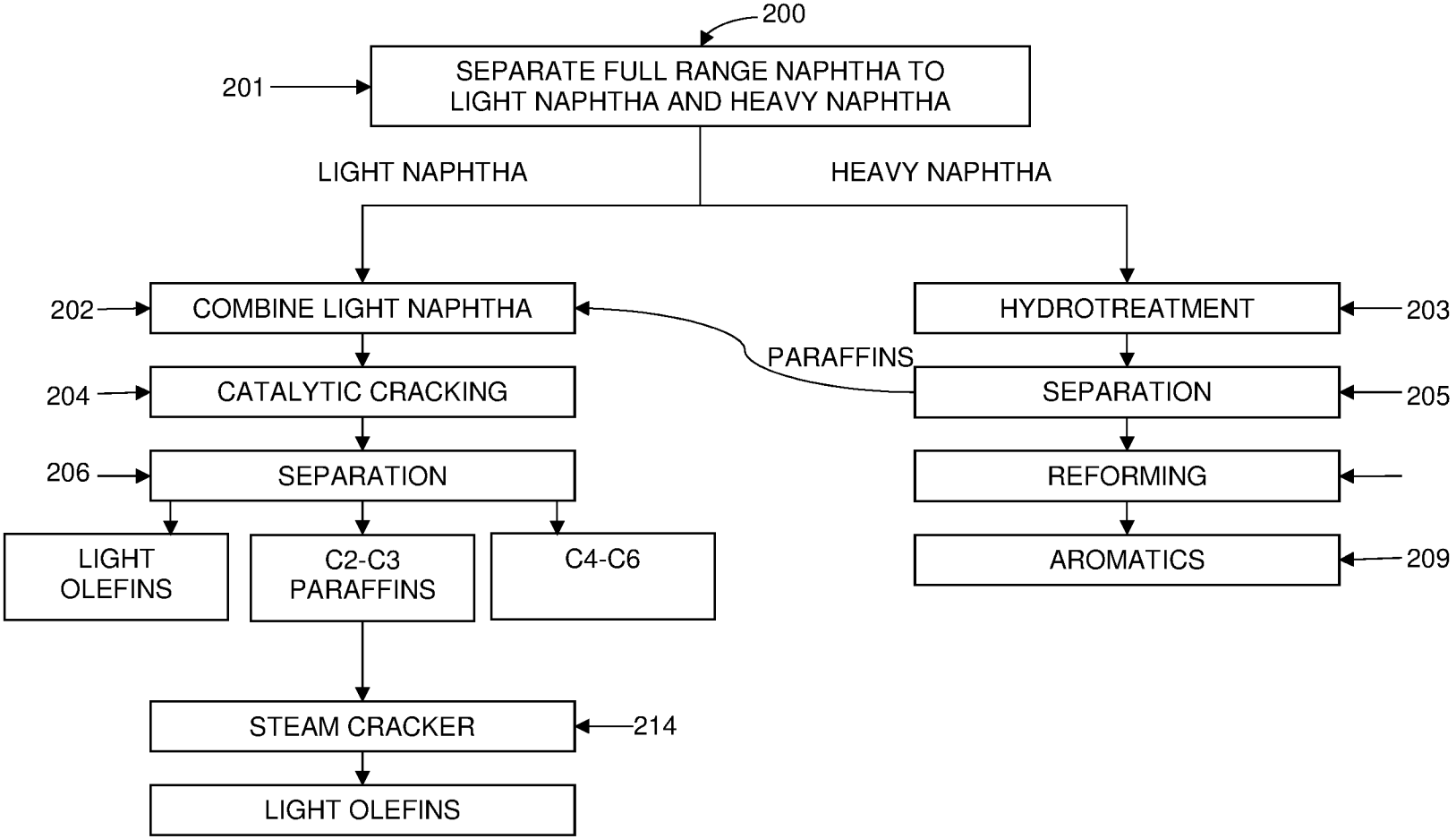
FIG. 2 shows a schematic diagram for a method for producing light olefins from full range naphtha, according to embodiments of the invention.

FIG. 2 is a process scheme diagram of cracking process integrated with the naphtha reforming associated with the required separation unit. The full range naphtha feed is split into light naphtha and heavy naphtha. The heavy naphtha is combined with a stream from the catalytic cracking unit recovery section having $C_6$ to $C_{12}$ hydrocarbons where both streams are hydrogenated/hydrotreated to remove impurities and saturate the olefins. The paraffins in the hydrotreated stream are further extracted leaving an easily reformable stream. The light naphtha and extracted paraffins are combined to make the feed for catalytic cracking.

According to embodiments of the invention, method 200 includes catalytic cracking of light naphtha and paraffins and reforming of heavy naphtha. The process begins at block 201 with the separation of light and heavy naphtha streams from a full range naphtha feed. The light naphtha feed processing is shown on the left, while heavy naphtha stream processing is shown on the right. At block 204, the light naphtha stream is catalytically cracked to produce light olefins and other products. In embodiments of the invention, catalytic cracking at block 204 is performed in catalytic cracking unit 105. Catalytic cracking unit 105 may comprise one or more catalytic cracking reactors and preferably is a fluid catalytic cracker. In embodiments of the invention, the catalytic cracking reactor may include a fixed bed reactor, a moving bed reactor, or a fluidized bed reactor. Catalytic cracking reactor 105 may include a catalyst comprising crystalline aluminosilicate (zeolites) clay-type filler and binder. The catalyst may also contain active matrix. Zeolites are commonly used molecular sieves (also known as crystalline aluminosilicate) in FCC processes. Others that may be used include X-type zeolites, Y-type zeolites, ferrierite, erionite, mordenite, faujasite, ST-5, ZSM-5, ZSM-11, ZSM-12, ZSM-23, ZSM-35, ZSM-38 and ZSM-48, germanium, gallium, or combinations thereof.

In embodiments of the invention, the reaction conditions for catalytic cracking at block 204 may include a reaction temperature of 600 to 800° C. and all ranges and values there between, including 600 to 610° C., 610 to 620° C., 620 to 630° C., 630 to 640° C., 640 to 650° C., 650 to 660° C., 660 to 670° C., 670 to 680° C., 680 to 690° C., and 690 to 700° C., and 700 to 800° C., and most preferably 800° C. The reaction conditions for catalytic cracking at block 204 may further include a reaction pressure of 0.5 to 10 bar and all ranges and values there between. The reaction conditions may further include a weight hourly space velocity in a range of 0.1 to 1000 $hr^{-1}$ and all ranges and values there between.

The products from the catalytic cracking unit are separated at block 206 into fuel oil light olefins, $C_2$ to $C_3$ paraffins, a $C_4$ to $C_6$ stream, a $C_7$ to $C_{12}$ stream and a $CH_4/H_2$ stream. The $C_2$ to $C_3$ paraffins are further converted in a steam cracking furnace 214 to light olefins. The $C_4$ to $C_6$ is recycled back to the catalytic cracker at block 204.

The $C_2$ to $C_3$ paraffin containing stream is steam cracked in a steam cracker unit to produce additional light olefins. The conditions in the steam cracker unit may include high temperature up to 1000° C. and low residence time of less than 100 seconds.

Turning now to treatment of the heavy stream, at block 203 heavy naphtha is hydrotreated to remove sulfur, nitrogen, if present, and undesirable di-olefin and olefin components. The hydrotreated effluent is separated at step 205 into a paraffin stream and olefins, if present, that is preferably combined with the light naphtha in block 202, and the remainder is reformed in a heavy naphtha reforming unit at step 207 to yield aromatics which are recovered at step 209. The conditions in the hydrotreater unit include a temperature less than 550° C., pressure in the range of 2 to 50 bars. In addition, hydrogen should be combined in certain ratio with the hydrotreater feed. The hydrotreated product contains less sulfur and/or nitrogen than the initial product, and aromatics are formed.

The conditions in the reforming unit include a temperature range from 450° C. to 580° C., and a pressure range from 1 to 50 bars.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

It is claimed:

1. A method for processing full range naphtha, the method comprising the steps of:

feeding full range naphtha to a separation unit, the full range naphtha having a final boiling point less than 250° C.; separating the naphtha, in the separation unit, to produce a light naphtha stream having a final boiling point in a range of 60° C. to 110° C. and a heavy naphtha stream having a final boiling point less than 250° C.;

hydrotreating the heavy naphtha stream in a hydrotreater unit to produce a hydrotreated stream;

separating the hydrotreated stream to produce a paraffinic stream comprising primarily $C_6$ to $C_{12}$ paraffins and a reformable stream comprising 40 to 80 wt. % aromatics and the remainder naphthene;

reforming the reformable stream to produce an aromatic stream comprising greater than 50 wt. % aromatics, wherein conditions in the reforming unit include a temperature range from 450° C. to 580° C. and a pressure range from 1 to 50 bars;

combining the light naphtha stream with the paraffinic stream to produce a combined stream;

catalytically cracking the combined stream in a fluid catalytic cracker to form a cracked stream;

separating the cracked stream to produce a plurality of product streams that include a first stream that comprises primarily $C_2$ to $C_3$ paraffins, a second stream comprising primarily methane and hydrogen, a third stream comprising primarily $C_2$ to $C_4$ olefins, a fourth stream primarily comprising $C_4$ to $C_6$ hydrocarbons, a fifth stream comprising primarily fuel oil, and a sixth stream comprising $C_6$-$C_{12}$ hydrocarbons; and steam cracking the first stream in a steam cracker to produce $C_2$ to $C_3$ olefins; and feeding the sixth stream to the hydrotreating unit.

2. The method of claim 1, wherein the catalytic cracking is performed in the presence of a catalyst comprising an active amorphous clay-type catalyst.

3. The method of claim 1, wherein the catalytic cracking is performed in the presence of a catalyst comprising germanium.

4. The method of claim 1, wherein the catalytic cracking is performed in the presence of a catalyst comprising gallium.

5. The method of claim 1, wherein the catalytic cracking is performed in the presence of a catalyst comprising ZSM-48.

6. The method of claim 5, wherein the catalyst further comprises active amorphous clay-type catalyst.

7. The method of claim 6, wherein the catalyst further comprises germanium.

8. The method of claim 6, wherein the catalyst further comprises gallium.

9. The method of claim 1, wherein the catalytic cracking is performed in the presence of a catalyst comprising germanium or gallium.

10. The method of claim 6, wherein the catalyst further comprises ZSM-35.

11. The method of claim 6, wherein the catalyst further comprises ZSM-38.

12. The method of claim 1, further comprising the step of recycling the fourth stream to the catalytic cracker.

13. The method of claim 1, wherein the catalytic cracking is performed in the presence of a catalyst selected from the group consisting of an active amorphous clay-type catalyst, a crystalline molecular sieve, X-type zeolites, Y-type zeolites, ferrierite, erionite, mordenite, faujasite, ST-5, ZSM-11, ZSM-12, ZSM-23, ZSM-35, ZSM-38, ZSM-48, germanium, gallium, and combinations thereof.

14. The method of claim 13, further comprising the step of feeding ethane and propane produced during the reforming to the steam cracker.

15. The method of claim 14, further comprising the step of recovering the $C_2$ to $C_4$ olefins from the third stream.

16. A method for processing full range naphtha, the method comprising the steps of:

feeding full range naphtha to a separation unit, the full range naphtha having a final boiling point less than 250° C.; separating the naphtha, in the separation unit, to produce a light naphtha stream having a final boiling point in a range of 60° C. to 110° C. and a heavy naphtha stream having a final boiling point less than 250° C.;

hydrotreating the heavy naphtha stream in a hydrotreater unit to produce a hydrotreated stream;

separating the hydrotreated stream to produce a paraffinic stream comprising primarily $C_6$ to $C_{12}$ paraffins and a reformable stream comprising 40 to 80 wt. % aromatics and the remainder naphthene;

reforming the reformable stream to produce an aromatic stream comprising greater than 50 wt. % aromatics, wherein conditions in the reforming unit include a temperature range from 450° C. to 580° C. and a pressure range from 1 to 50 bars;

combining the light naphtha stream with the paraffinic stream to produce a combined stream;

catalytically cracking the combined stream in a fluid catalytic cracker to form a cracked stream;

separating the cracked stream to produce a plurality of product streams that include a first stream that comprises primarily $C_2$ to $C_3$ paraffins, a second stream comprising primarily methane and hydrogen, a third stream comprising primarily $C_2$ to $C_4$ olefins, a fourth stream primarily comprising $C_4$ to $C_6$ hydrocarbons, a fifth stream comprising primarily fuel oil, and a sixth stream comprising $C_6$-$C_{12}$ hydrocarbons;

steam cracking the first stream in a steam cracker to produce $C_2$ to $C_3$ olefins;

recycling the fourth stream to the catalytic cracker; and feeding the sixth stream to the hydrotreating unit.

17. A method for processing full range naphtha, the method comprising the steps of:

feeding full range naphtha to a separation unit, the full range naphtha having a final boiling point less than 250° C.; separating the naphtha, in the separation unit, to produce a light naphtha stream having a final boiling point in a range of 60° C. to 110° C. and a heavy naphtha stream having a final boiling point less than 250° C.;

hydrotreating the heavy naphtha stream in a hydrotreater unit to produce a hydrotreated stream;

separating the hydrotreated stream to produce a paraffinic stream comprising primarily $C_6$ to $C_{12}$ paraffins and a reformable stream comprising 40 to 80 wt. % aromatics and the remainder naphthene;

reforming the reformable stream to produce an aromatic stream comprising greater than 50 wt. % aromatics, wherein conditions in the reforming unit include a temperature range from 450° C. to 580° C. and a pressure range from 1 to 50 bars;

combining the light naphtha stream with the paraffinic stream to produce a combined stream;

catalytically cracking the combined stream in a fluid catalytic cracker to form a cracked stream;

separating the cracked stream to produce a plurality of product streams that include a first stream that comprises primarily $C_2$ to $C_3$ paraffins, a second stream comprising primarily methane and hydrogen, a third stream comprising primarily $C_2$ to $C_4$ olefins, a fourth stream primarily comprising $C_4$ to $C_6$ hydrocarbons, a fifth stream comprising primarily fuel oil, and a sixth stream comprising $C_6$-$C_{12}$ hydrocarbons;

recycling the fourth stream to the catalytic cracker; and feeding the sixth stream to the hydrotreating unit.

* * * * *